US006158818A

United States Patent [19]

Schaeff et al.

[11] Patent Number: 6,158,818

[45] Date of Patent: Dec. 12, 2000

[54] ROCK CUTTING HEAD

[75] Inventors: Hans Schaeff, Langenburg, Germany; Ian Frederick Webster, Sheffield, United Kingdom

[73] Assignee: Webster Schaeff & Co., Rotherham, United Kingdom

[21] Appl. No.: 08/964,893

[22] Filed: Nov. 5, 1997

[30] Foreign Application Priority Data

Nov. 6, 1996 [DE] Germany ..... 196 45 650

[51] Int. Cl.[7] ..... E21C 25/18

[52] U.S. Cl. ..... 299/78; 37/403

[58] Field of Search ..... 299/78, 39.4, 39.6, 299/41.1; 37/403, 189, 462

[56] References Cited

U.S. PATENT DOCUMENTS 5,478,139 12/1995 Scott ..... 299/78 X

FOREIGN PATENT DOCUMENTS 563234 12/1957 Belgium ..... 299/78
2323001 1/1977 France .
2447604 A1 4/1976 Germany .
338730 9/1977 Germany .
339235 10/1977 Germany .
3316840 A1 11/1984 Germany .
3820264 A1 1/1989 Germany .
3823762 A1 1/1989 Germany .
3739110 A1 6/1989 Germany .
2067232 7/1979 United Kingdom .
2189278 10/1987 United Kingdom .

OTHER PUBLICATIONS

European Search Report, EP 0841 467 A1 (1998).
Stirnrad II, 1985.
Schramgetriebe–315/K–LMS, 1985.
Abtriebsrad, 1985.

*Primary Examiner*—Eileen D. Lillis
*Assistant Examiner*—Sunil Singh
*Attorney, Agent, or Firm*—Shlesinger Arkwright & Garvey, LLP

[57] ABSTRACT

Rock cutting head comprising a one-part steel housing attachable to a working machine lug, an electric or hydro motor being attached to the rear portion of the housing and two uni-axial similar cutting drums being provided at its front portion, the rear housing portion, in which a drive pinion directly or indirectly connected to the motor is provided, being terminated toward the lug with a widened connection plate, its front portion supporting outer bearing hubs, in which the shafts of the two cutting drums uniformly connected to a middle drive spur-toothed wheel are provided and wherein a larger intermediate wheel is provided in the housing between drive pinion and drive spur-toothed wheel.

21 Claims, 4 Drawing Sheets

ROCK CUTTING HEAD

BACKGROUND OF THE INVENTION

A rock cutting head is known from DE 33 16 840 A1. This document describes a rock cutting head with a housing mountable to an extension arm or lug connection, wherein it is known herefrom to arrange a drive pinion in the rear portion of the housing directly or indirectly connected to the rotational drive. The housing is closed or terminated by a plate in the rear portion. Intermediate wheels are provided as a gear connection between the drive pinion and a spur-toothed wheel. It further follows from this document that in the front portion of the housing the shafts of the two cutting drums connected to the spur-toothed wheel are arranged in outer bearing hubs in the front portion of the housing. This construction is relatively cumbersome and prone to wear.

From DE 38 20 264 A1 it is known to form the housing of a drive assembly for the cutting or hewing heads or drums of a shearing and heading machine from steel in one piece.

Rock cutters are furthermore known from tunnel construction and mining, where they are used as advance working or mining machines accomodated to the respective conditions, usually provided with only one rotating cutting head. Cutting heads with two cutting drums are also known, which are used for heavy universal diggers in alternative use together with digging tools.

In the construction of cutting heads problems arise in that for effective advance work the cutting drum shall be able to cut into solid rock of the facing in an unimpeded manner without being impaired by its connection to the extension arm of the advance working machine and without endangering this connection. In order to keep low the constructional requirements for long load transmission paths and their encapsulation, it is also necessary to arrange the drive motor and a corresponding step-down gear as close to the cutting drum as possible, at the same time, however, protecting these drive means against external influences by the rough working operation.

In order to achieve this it is known to house a step-down planetary gear directly in the cutting drum, or, with a cutting head with two uni-axial cutting drums, to re-orientate the actuation thereof from a hydro- or electric motor arranged centrally in the connection housing by means of bevel wheels. In view of the fact that cutting drums are stressed up to the point of standstill during usage, and are often abusively used as digging-or handling tools, thereby caused overloads necessarily lead to premature gear defects. As especially with planetary gears all toothed wheels engage one another in close arrangement, the splintering off of a small part of a bearing or a tooth is sufficient to destroy the whole gear to an extent that repair work can usually not be undertaken in an economically viable manner. Furthermore, the danger exists that by introducing forces, which a digging tool exchangeably mounted on an extension arm can withstand, the substantially more sensitive cutting head will be overstressed and its housing at least elastically deformed, whereby the bevel wheel gear can be destroyed.

OBJECTS AND SUMMARY OF THE INVENTION

It is the object of the invention to improve a rock cutting head of the mentioned type in so far, as a robust, compact overall construction can be manufactured from relatively few low-wear, and in case of repairs, individually exchangeable parts, wherein the housing, gear parts and bearings shall be able to receive stresses exceeding the forces occuring during the cutting action of the cutting drums, which for example occur during the occasional usage of the cutting head as a digging- or pushing tool.

This object is achieved by a rock cutting head, comprising a one-part steel housing attachable to a working machine lug, an electric or hydro motor being attached to the rear portion of the housing and two uni-axial similar cutting drums being provided at its front portion, the rear housing portion, in which a drive pinion directly or indirectly connected to the motor is provided, being terminated toward the lug by means of a widened connection plate, its front portion supporting outer bearing hubs, in which the shafts of the two cutting drums uniformly connected to a middle drive spur-toothed wheel are provided and wherein a larger intermediate wheel is provided in the housing between drive pinion and drive spur-toothed wheel.

According to the invention there is now provided a rock cutting head, in which the exchangeability of parts during repair is facilitated, and which furthermore has a robust and compact overall construction.

With the suggested construction a rock cutting head is provided, the uni-axial cutting drums of which are supported on the extension arm/lug via a slender gear housing arranged centrally therebetween, by means of which wide range cutting work is not or at least only negligably obstructed. As the housing must receive only a train of gears of three toothed wheels arranged behind one another, it can be provided in a one-piece, slender or space-saving as well as torsion- or deformation-stiff manner. By means of the stiffness of the housing as also by means of the small number of therein received toothed wheels, which can be provided as spur wheels, the danger of premature gear wear is essentially eliminated. Furthermore, the simple gear elements are easily mountable, accessible and replaceable within the housing.

Further features and advantages of the rock cutting head follow from the dependent claims and the following description of embodiments shown in the figures.

DETAILED DESCRIPTION OF THE PREFERRED EMBODIMENTS

Figure 1:
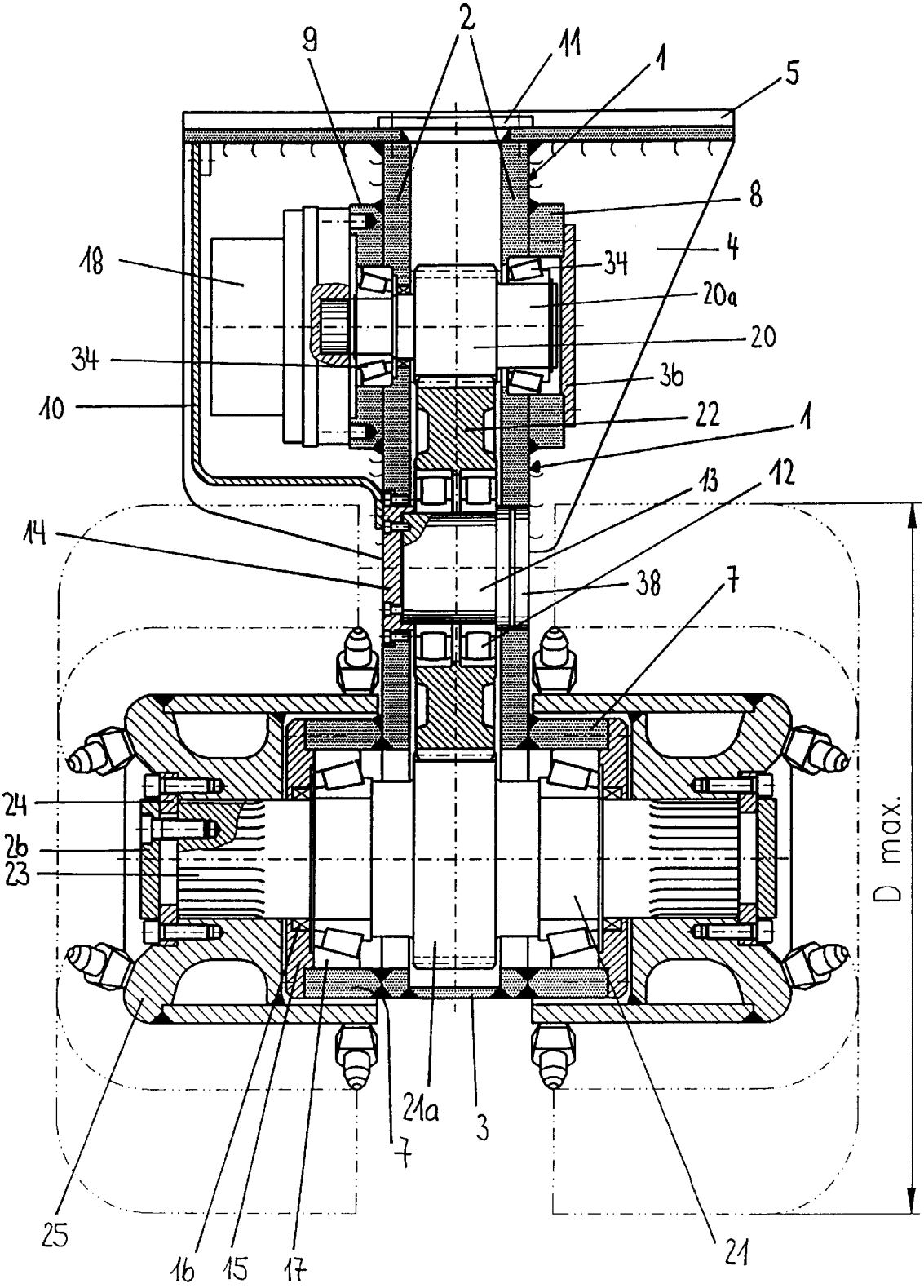
FIG. 1 shows schematically a longitudinal sectional view of a cutting head according to the invention driven by a single hydraulic high-moment-motor, for example a radial piston motor.
Figure 2:
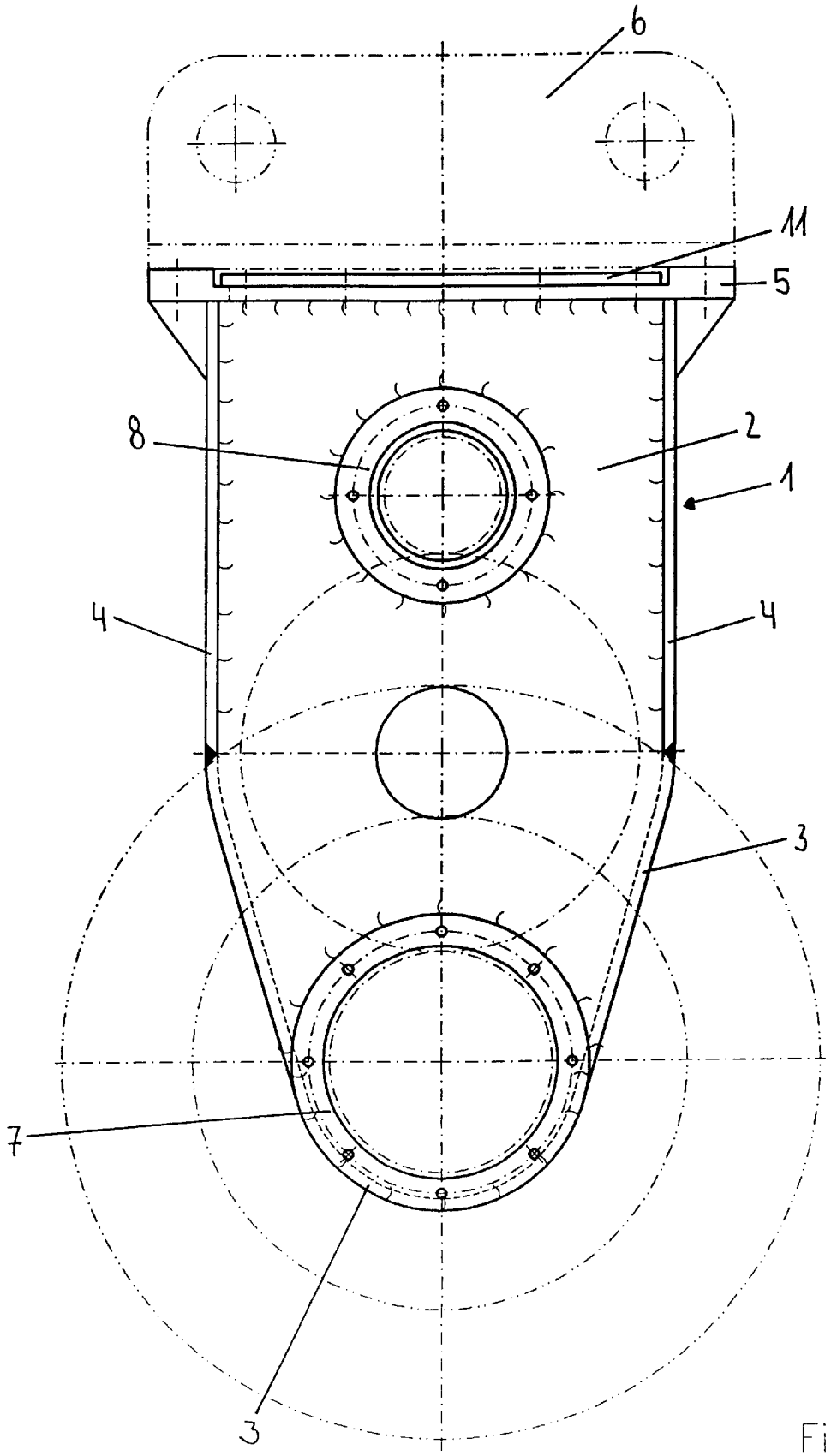
FIG. 2 shows schematically a side view of a gear housing provided as a one-piece welding construction, in which possible cutting drum diameters and an extension arm connection console are shown in phantom lines.

In accordance with FIGS. 1 and 2 the gear housing 1 comprises a one-piece welding construction, the rear opening of which is closed by a removeable mounting lid 11. The welding construction comprises two essentially similar side plates 2 arranged in spaced relationship to one another according to the width of the toothed wheels of the gear provided in the housing, as well as surrounding walls 4 connecting the edges thereof, and extending parallel over half the housing length starting from the rear portion of the housing with a minimal spacing defined by the circumference of intermediate wheel 22, and then lead in a tapering curve around a rounded front housing end. The side plates 2 can be connected to one another by a correspondingly bent intermediate piece 3 in the area of the tapered rounded front housing end, the intermediate piece 3 forming an extension of the straight surrounding walls 4. At the rear end of housing 1 a widened connection plate 5 is mounted, which lies opposite a connection console 6 of the extension arm or lug and comprises an opening corresponding to the cross-section of the housing 1.

Bearing hubs 7 for a drum shaft 21 are welded to the side plates 2 on the outer side thereof at the front end of the housing, the drum shaft 21 comprising a shaft portion and a reinforced middle portion formed as a drive spur wheel 21*a* for each cutting drum. In the rear housing portion bearing hubs 8 and 9 for a shaft 20*a* supporting the drive pinion 20 are welded to the side plates.

The surrounding walls 4 are, corresponding to FIG. 1, widened in the rear portion of the housing 1 at both sides and there connected with connection plate 5 for mutual stiffening, in order to form, together with a guard plate 10, a cover for the driving means, for example motor 18, connected on the level of the drive pinion 20 at the outside of side plates 2. In case of a cast construction the pre-described housing type can directly be taken over for a cast part, without the surrounding walls 4 having to be provided as a widened guard cover.

In the example of FIG. 1 a hydraulic radial piston motor 18 is flange-mounted to the bearing hub 9, the motor 18 being provided in driving connection with the shaft 20*a* of the drive pinion 20 supported on tapered roller bearings 34. The bearing hub 8 and its supporting side plate 2 comprise sufficiently large openings for insertion of drive pinion 20 as well as for receiving tapered roller bearings 34. The bearing hub 8 is closed by a screwable mounting lid 36. The opposite part of shaft 20*a* is sealed by means of an anualar collar and a shaft sealing in an opening of the left side plate 2 in FIG. 1, and supported by an end portion of reduced diameter in a tapered roller bearing 34 received in bearing hub 9. The tapered roller bearings 34 used in this embodiment receive the axial forces occuring due to the control play of the radial piston motor 18.

The larger intermediate wheel 22 of the step-down gear is inserted together with pre-assembled roller bearings 12 through the rear opening of housing 1 and supported with these on a bearing stud 13 inserted into the side plates 2 via assembly openings. The bearing stud 13 is supported by means of a reinforced terminal collar 38 in the right side plate 2 and fixed to the opposite end via lid 14 closing the assembly opening. Intermediate wheel 22 is in engagement with the drive pinion 20 as well as with the spur wheel 21*a* of drum shaft 21.

Drum shaft 21 with its uniform middle driving spur wheel 21*a* is inserted into housing 1 through bearing hubs 7 and the openings in the extensions thereof in the side plates, and supported by means of tapered roller bearings 17. Bearing lids 15, which are screwable to the outside of bearing hubs 7, serve to fixedly position the drum shaft 21, shaft sealings 16 being provided in bearing lids 15. Cutting drums 25 are respectively attached or slipped on to a spline shaft toothing 23 of the outer drum shaft portions and positioned by means of holding rings 24 as well as screwed on lids 26.

Cutting drums 25, the possible maximum and minimum diameters of which, for example for soft rock or hard rock, are indicated in FIG. 1 by phantom lines, are driven, according to the material and the drum diameter, with a rotational speed between about 40 and 60 rev/min. If the transmission radius with the spur wheels in housing 1 lies between about 1:1.5 to 1:2, the high moment motor 18 rotates with about 100 rev/min in the example of FIG. 1. If an electric motor is used as actuation or drive means, rotating at 50 Hz a.c. with 1500 rev/min, a total transmission radius of about 1500/50=30 is necessary, and for this reason in the case of the example shown in FIG. 4 the provided planetary gear 32 must reach a transmission i of 30/1.5=20 and therefore must be of the two-stage type.

Figure 3:
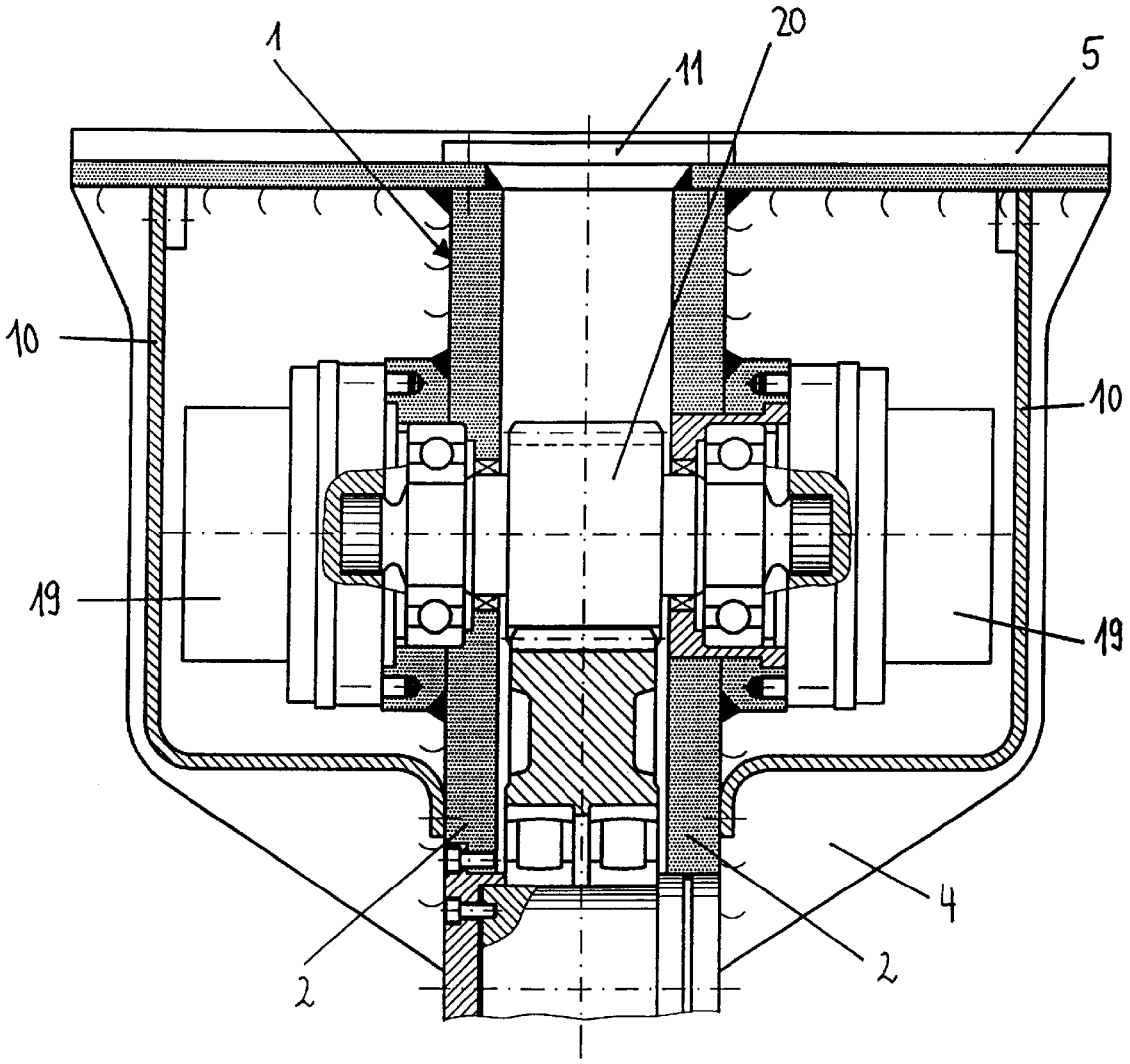
FIG. 3 shows schematically a vertical part-sectional view through a cutting head according to the invention with two similar medium moment motors, for example wing cell motors, acting upon the drive pinion.
Figure 4:
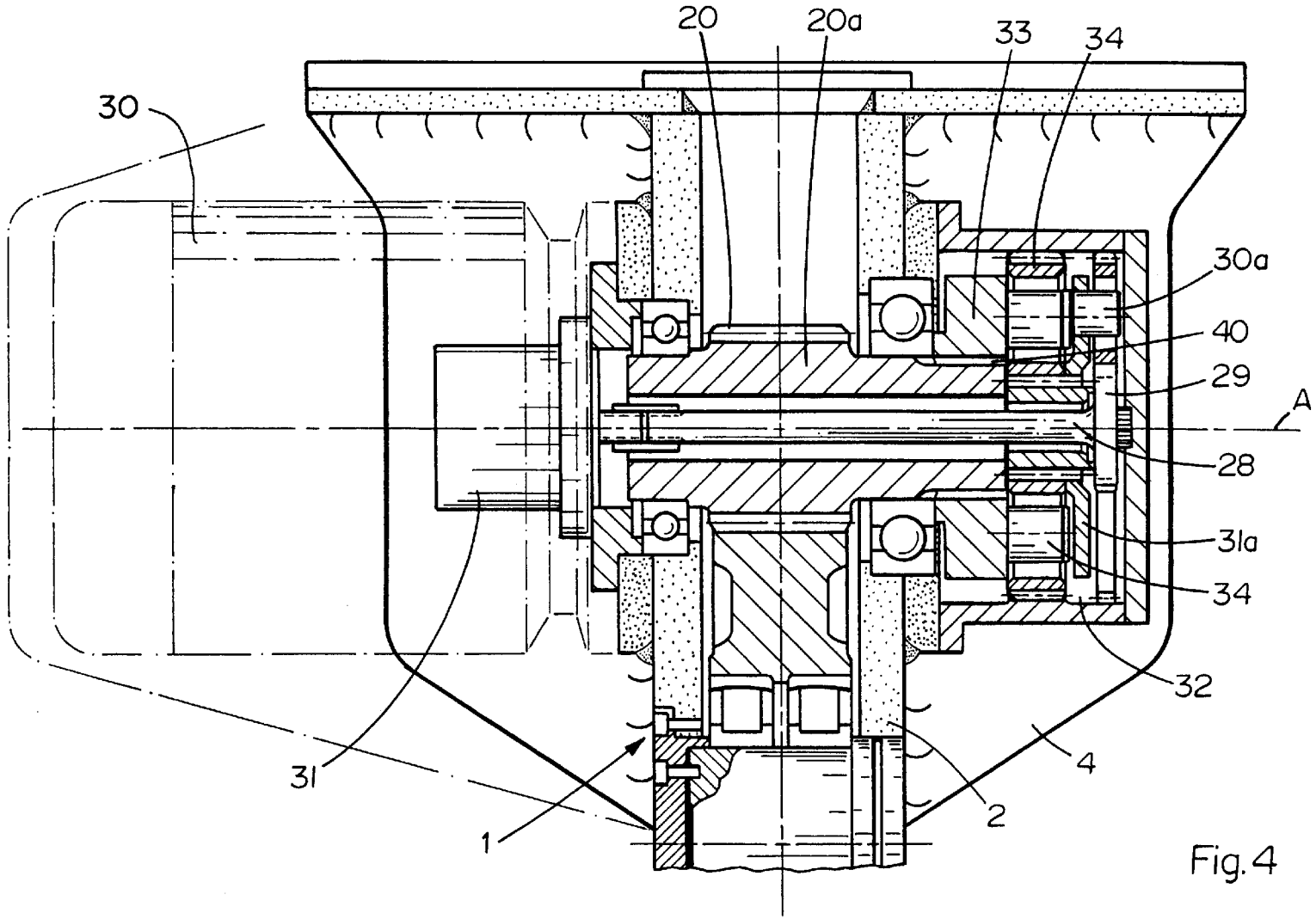
FIG. 4 shows schematically a vertical part-sectional view through a further embodiment of a cutting head according to the invention with a high-speed hydraulic motor, for example of the toothed wheel of axial piston type, which can be replaced by an electric motor indicated by phantom lines.

In the embodiments according to FIGS. 3 and 4 normal ball bearings can be used, as no axial forces occur. This follows in FIG. 3 due to two similar hydraulic medium-moment motors 19 connected oppositely on the shaft 20*a* of the drive pinion 20, the housings of motors 19 being screwed to the bearing hubs 8, 9. According to FIG. 4 an intermediate shaft 28 is connected to a relatively high speed hydraulic motor 31 of the axial piston type or to an electric motor 30, the intermediate shaft 28 extending through a centrical bore of the drive pinion shaft 20*a* and connected to a sun wheel 29 of the two-stage planetary gear 32, the main drive pinion 33 of which is directly connected or slipped on to a spline shaft toothing 40 of shaft 20*a*. By using the shown cheap ball bearings with large inner diameter, the main drive pinion 33 and its shaft 20*a* retain their full stability despite the through bore.

Sun wheel 29 is rotated by driving motor 31 via shaft 28. Rotation of sun wheel 29 results in a planetary rotation of bolt or shaft 30*a*. Bolt or shaft 30*a* is interconnected with wheel 31*a* which is also set in rotation about axis A. Wheel 31*a* drives planetary wheels 34 which are connected with main drive pinion 33. Main drive pinion 33 in turn drives shaft 20*a* of drive pinion 20 via teeth 40.

The acutation or drive variations shown in FIGS. 3 and 4 offer further possibilities for adaptation of the cutting head 2 to various carrier machines or vehicles. Without changing or modifying the robust spur wheel gear or abondaning the possibilities of necessary repairs on an additionally needed planetary gear, a multitude of actuation motors with various revolution speeds and torques can be modified according to the cutting requirements by one to three stage planetary gears.

What is claimed is:

1. A rock cutting head comprising:

a) a housing, said housing having a front portion and a rear portion aligned along a longitudinal axis thereof, said rear portion having a width;

b) at least one drive motor having a drive axis for driving cutting drums, said at least one drive motor is mounted to said housing rear portion;

c) a pair of cutting drums mounted to a shaft, said pair of cutting drums and said shaft are carried by said housing front portion and said pair of cutting drums shaft extends parallel to said at least one drive motor drive axis;

d) a gear unit provided within said housing and between said at least one drive motor and said shaft, said gear unit comprising a drive pinion gear operably connected to said at least one drive motor, a spur wheel operatively connected to said shaft and an intermediate wheel disposed between said pinion gear and said spur wheel for translating rotation from said pinion gear to said spur wheel, said intermediate wheel is at least larger than said pinion gear and said spur wheel;

e) said housing including at least one opening extending therethrough and disposed adjacent at least one of said drive pinion gear, said intermediate wheel and said spur wheel, said at least one opening having a removable lid; and f) a connecting plate assembly for connecting said rock cutting head to an extension arm of a working machine, said connecting plate assembly is secured to said rear portion of said housing to provide a unitary structure therewith and extends perpendicular to the longitudinal axis thereof and has a width at least greater than that of said width of said rear portion of said housing.

2. A rock cutting head as in claim 1 and wherein:

a) said housing having interconnected side walls, said interconnected side walls sufficiently spaced apart so as to provide a housing having an interior adapted to receive each of said pinion gear, said spur wheel and said intermediate wheel within said housing, said width of said housing rear portion extending from said connecting plate assembly to about said intermediate wheel is at least greater than the circumference of said intermediate wheel and tapers therefrom towards said housing front portion.

3. A rock cutting head as in claim 2 and further comprising:

a) a pair of coaxially aligned bearing hubs having a circumference, each of said pair of bearing hubs is mounted to a separate one of said interconnected side walls at said housing front portion and through which said cutting drums shaft extends and between which said spur wheel is disposed, said tapered housing width about said spur wheel corresponds to about said circumference of said pair of aligned bearing hubs.

4. A rock cutting head as in claim 2 and wherein:

a) said drive pinion gear having a first end and an opposite second end and including a centrical bore extending therethrough from said drive pinion gear first end to said drive pinion gear second end, said drive pinion gear centrical bore further including a connecting shaft extending therethrough, said connecting shaft having first and second ends, said at least one drive motor is operatively connected to said connecting shaft first end for selective rotation of the same and said connecting shaft second end is operatively connected to a step-down planetary gear mechanism adapted to rotate said drive pinion gear.

5. A rock cutting head as in claim 1 and wherein:

a) each of said drive pinion gear, said spur wheel and said intermediate wheel are provided with respective bearing assemblies comprising at least one of bearings, and bearing studs, said respective bearing assemblies are adapted to be insertable and removable through a respective one of said at least one opening.

6. A rock cutting head as in claim 5 and wherein:

a) said at least one housing opening adjacent said drive pinion gear extends through said connecting plate assembly and is adapted to receive therethrough said intermediate wheel and said respective intermediate wheel bearing assembly.

7. A rock cutting head as in claim 6 and wherein:

a) said at least one housing opening adjacent said intermediate wheel is adapted to receive therethrough said intermediate wheel bearing stud of said respective intermediate bearing assembly for supporting said intermediate wheel bearing, said at least one housing opening adjacent said intermediate wheel including a removable lid member.

8. A rock cutting head as in claim 6 and further including:

a) a removable mounting lid operably associated with said at least one housing opening extending through said connecting plate assembly.

9. A rock cutting head as in claim 1 and further comprising:

a) at least one surrounding wall for reinforcing said housing, said at least one surrounding wall is connected to said housing and said connecting plate assembly and extends beyond the width of said rear portion of said housing and perpendicular to said connecting plate assembly.

10. A rock cutting head as in claim 9 and further comprising:

a) a guard plate for covering said drive motor, said guard plate connected to said rear housing portion.

11. A rock cutting head as in claim 1 and further comprising:

a) a second drive motor, said second drive motor operatively connected to said drive pinion gear, each of said at least one drive motor and said second drive motor are connected to said drive pinion gear in an opposed relation for driving the same.

12. A rock cutting head as in claim 11 and wherein:

a) said at least one drive motor and said second drive motor are selected from the group of drive motors consisting of hydraulic medium-moment motors and electric motors.

13. A rock cutting head as in claim 1 and further including:

a) at least one removable cutting drum lid, said at least one cutting drum lid is provided on said housing front portion and coaxially aligned with said pair of cutting drums shaft for providing selective access to said pair of cutting drums shaft through said housing front portion when said lid is removed.

14. A rock cutting head as in claim 1 and further including:

a) a connection console operably associated with said connecting plate assembly.

15. A rock cutting head comprising:

a) a housing, said housing having a front portion and a rear portion aligned along a longitudinal axis thereof, said rear portion having a width;

b) a first drive motor having a drive axis and a second drive motor having a drive axis for driving a pair of cutting drums, said first and second drive motors are mounted to said housing rear portion;

c) a pair of cutting drums mounted to a shaft, said pair of cutting drums and said shaft are carried by said housing front portion and said pair of cutting drums shaft extends parallel to said first drive motor drive axis and said second drive motor drive axis;

d) a gear unit provided within said housing and between said first and second drive motors and said cutting drum shaft, said gear unit comprising a drive pinion gear including a shaft having first and second ends, each of said first and second drive motors is operably connected to a separate one of said drive pinion gear ends for driving said drive pinion gear, a spur wheel operatively connected to said pair of cutting drums shaft and an intermediate wheel disposed between said pinion gear and said spur wheel for translating rotation from said pinion gear to said spur wheel, said intermediate wheel is at least larger than said pinion gear and said spur wheel;

e) said housing including at least one opening extending therethrough and disposed adjacent at least one of said drive pinion gear, said intermediate wheel and said spur wheel, said at least one opening having a removable lid; and f) a connecting plate assembly for connecting said rock cutting head to an extension arm of a working machine, said connecting plate assembly is secured to said rear portion of said housing to provide a unitary structure therewith and extends perpendicular to the longitudinal axis thereof and has a width at least greater than that of said width of said rear portion of said housing.

16. A rock cutting head as in claim 15 and further including:

a ) a connection console operably associated with said connecting plate assembly.

17. A rock cutting head as in claim 15 and further including:

a) a removable mounting lid operably associated with said connecting plate assembly.

18. A rock cutting head comprising:

a) a housing, said housing having a front portion and a rear portion aligned along a longitudinal axis thereof, said rear portion having a width;

b) at least one drive motor having a drive axis for driving a pair of cutting drums, said at least one drive motor is mounted to said housing rear portion;

c) a pair of cutting drums mounted to a shaft, said pair of cutting drums and said shaft are carried by said housing front portion and said pair of cutting drums shaft extends parallel to said at least one drive motor drive axis;

d) a gear unit provided within said housing and between said at least one drive motor and said shaft, said gear unit comprising a drive pinion gear operably connected to said at least one drive motor, a spur wheel operatively connected to said shaft and an intermediate wheel disposed between said pinion gear and said spur wheel for translating rotation from said pinion gear to said spur wheel, said intermediate wheel is at least larger than said pinion gear and said spur wheel, said drive pinion gear having a first end and an opposite second end and including a centrical bore extending therethrough from said drive pinion gear first end to said drive pinion gear second end, said drive pinion gear centrical bore further including a connecting shaft rotatable therein said connecting shaft having first and second ends, said at least one drive motor is operatively connected to said connecting shaft first end for causing selective rotation of the same and said connecting shaft second end is operatively connected to a step-down planetary gear mechanism adapted to rotate said drive pinion gear;

e) said housing including at least one opening extending therethrough and disposed adjacent at least one of said drive pinion gear, said intermediate wheel and said spur wheel, said at least one opening having a removable lid; and f) a connecting plate assembly for connecting said rock cutting head to an extension arm of a working machine, said connecting plate assembly is secured to said rear portion of said housing to provide a unitary structure therewith and extends perpendicular to the longitudinal axis thereof and has a width at least greater than that of said width of said rear portion of said housing.

19. A rock cutting head as in claim 18 and further including:

a) a connection console operably associated with said connecting plate assembly.

20. A rock cutting head as in claim 18 and further including:

a) a removable mounting lid operably associated with said connecting plate assembly.

21. A rock cutting head comprising:

a) a housing, said housing having a front portion and a rear portion aligned along a longitudinal axis thereof, said rear portion having a width;

b) at least one drive motor having a drive axis for driving cutting drums, said at least one drive motor is mounted to said housing rear portion;

c) a pair of cutting drums mounted to a shaft, said pair of cutting drums and said shaft are carried by said housing front portion and said pair of cutting drums shaft extends parallel to said at least one drive motor drive axis;

d) a gear unit provided within said housing and between said at least one drive motor and said shaft, said gear unit consisting essentially of a drive pinion gear operably connected to said at least one drive motor, a spur wheel operatively connected to said shaft and an intermediate wheel disposed between said pinion gear and said spur wheel for translating rotation from said pinion gear to said spur wheel, said intermediate wheel is at least larger than said pinion gear and said spur wheel;

e) said housing including at least one opening extending therethrough and disposed adjacent at least one of said drive pinion gear, said intermediate wheel and said spur wheel, said at least one opening having a removable lid; and f) a connecting plate assembly for connecting said rock cutting head to an extension arm of a working machine, said connecting plate assembly is secured to said rear portion of said housing to provide a unitary structure therewith and extends perpendicular to the longitudinal axis thereof and has a width at least greater than that of said width of said rear portion of said housing.

* * * * *